United States Patent [19]

Torizuka

[11] Patent Number: 4,530,335

[45] Date of Patent: Jul. 23, 1985

[54] IN-LINE TYPE FUEL INJECTION PUMP FOR INTERNAL COMBUSTION ENGINES

[75] Inventor: Keizi Torizuka, Higashimatsuyama, Japan

[73] Assignee: Diesel Kiki Co., Ltd., Tokyo, Japan

[21] Appl. No.: 508,899

[22] Filed: Jun. 28, 1983

[30] Foreign Application Priority Data

Jul. 6, 1982 [JP] Japan ..... 57-102125[U]

[51] Int. Cl.[3] ..... F02M 59/44

[52] U.S. Cl. ..... 123/495; 417/490; 417/533

[58] Field of Search ..... 123/495, 446; 417/499, 417/490, 533, 539

[56] References Cited

U.S. PATENT DOCUMENTS

| | | | |
|---|---|---|---|
| 2,106,932 | 2/1938 | Rosen | 123/495 |
| 2,975,776 | 3/1961 | Nicolls | 123/495 |
| 3,759,637 | 9/1973 | Vuaille | 123/495 |
| 3,818,882 | 6/1974 | Leonov et al. | 123/495 |
| 4,222,717 | 9/1980 | Clouse et al. | 417/499 |

FOREIGN PATENT DOCUMENTS

| | | | |
|---|---|---|---|
| 2547071 | 5/1977 | Fed. Rep. of Germany | 123/495 |
| 2042066 | 9/1980 | United Kingdom | 123/495 |

*Primary Examiner*—Magdalen Y. C. Moy

*Attorney, Agent, or Firm*—Frishauf, Holtz, Goodman & Woodward

[57] ABSTRACT

In an in-line type fuel injection pump, the pump housing is formed with a plurality of pump accommodating spaces arranged in a line, each of which accommodates a pump assembly including a plunger barrel and a plunger slidably fitted therein, and adjacent ones of which are separated from each other by a partition wall portion extending therebetween. A plurality of fuel passages are formed in the pump housing, which extend from the outer wall surface of the pump housing to respective ones of the partition wall portions. Each of the fuel passages has an interior diameter larger than the width of the corresponding partition wall portion so that the inner end of the fuel passage opens in both of the two adjacent pump accommodating spaces to communicate them with each other. On the other hand, the outer end of each of the fuel passages opens in the outer wall surface of the pump housing. Part of the fuel passages serve as fuel intake passages, and the other as fuel retain passages, respectively.

9 Claims, 4 Drawing Figures

IN-LINE TYPE FUEL INJECTION PUMP FOR INTERNAL COMBUSTION ENGINES

BACKGROUND OF THE INVENTION

This invention relates to fuel injection pumps for internal combustion engines, and more particularly to an in-line type fuel injection pump which facilitates machining of its pump housing.

An in-line type fuel injection pump in general for use with a Diesel engine has a plurality of pump assemblies formed essentially of plungers and plunger barrels corresponding in number to the cylinders of the engine and arranged in a line. Each of the pump assemblies is accommodated in a pump accommodating space formed in the pump housing and has a fuel chamber formed in the pump accommodating space and supplied with fuel from a fuel tank, via a fuel intake connector mounted on the pump housing and connected to the fuel tank. Conventional measures for guiding fuel from the fuel intake connector to the fuel chamber of each of the pump assemblies include a method of boring the fuel chamber to a large interior diameter so that the fuel chambers of adjacent pump assemblies are in communication with each other, at least one of which is in communication with the fuel intake connector, a method of forming communication holes in the pump housing, each communicating the fuel chamber of its corresponding pump assembly with the fuel intake connector, and a method of forming a lateral side hole in the pump housing, which opens in the fuel chamber of each pump assembly, so as to communicate the fuel chambers with each other by the side hole, at least one of the fuel chambers being in communication with the fuel intake connector.

However, any of the above conventional measures requires complicate machining, especially boring, of the pump housing, and the more the number of the pump assemblies of the pump, the more difficult such machining becomes. This results in low productivity and accordingly a high manufacturing cost of the pump, as well as in difficulties in designing the pump compact in size.

SUMMARY OF THE INVENTION

It is an object of the invention to provide an in-line type fuel injection pump for internal combustion engines, which facilitates machining of the pump housing, thereby having improved productivity and low manufacturing costs.

It is a further object of the invention to provide an in-line type fuel injection pump for internal combustion engines, in which the pump assemblies can be arranged with small distances therebetween, thus permitting designing compact in size.

An in-line type fuel injection pump according to the invention includes a pump housing having a plurality of pump accommodating spaces formed therein and arranged in a line, and a plurality of partition wall portions separating adjacent ones of the pump accommodating spaces from each other. Accommodated, respectively, in the pump accommodating spaces are a plurality of pump assemblies, each including a plunger barrel mounted within a corresponding one of the pump accommodating spaces, and a plunger disposed for reciprocating motion within the plunger barrel for pressure delivery of fuel. A plurality of fuel passages are formed in the pump housing, which extend from the outer wall surface of the pump housing to respective ones of the partition wall portions. Each of the fuel passages has an interior diameter larger than the width of a corresponding one of the above partition wall portions. Further, each of the fuel passages has an inner end terminating in both of the the inner peripheral wall surfaces of the above two adjacent ones of the pump accommodating spaces at predetermined regions to thus communicate them with each other, and has an outer end terminating in the outer wall surface of the pump housing.

The above and other objects, features and advantages of the invention will be more apparent from the ensuing detailed description taken in conjunction with the accompanying drawings.

DETAILED DESCRIPTION

Figure 1:
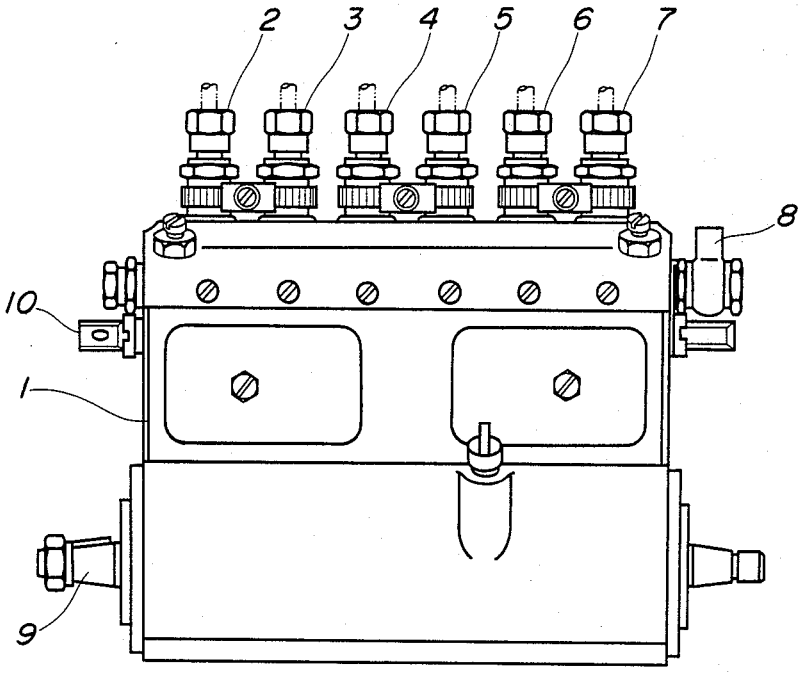
FIG. 1 PRIOR ART
FIG. 1 is a schematic front view illustrating a typical conventional in-line type fuel injection pump adapted for use with a Diesel engine.

Referring first to FIG. 1, there is illustrated, by way of example, the whole arrangement of an in-line type fuel injection pump which is generally used in Diesel engines. The fuel injection pump has a pump housing 1, and a plurality of, e.g. six, pump assemblies 2–7 corresponding in number to the cylinders of the engine, arranged longitudinally of the pump housing in a line. Each of the pump assemblies 2–7 has a pump accommodating space, not shown, in which are accommodated a plunger barrel and a plunger, neither of which is shown. A fuel chamber, not shown, is formed in each of the pump accommodating spaces, which is supplied with fuel through a fuel intake connector 8 mounted at one end of the pump housing 1. A camshaft 9, which is rotatively driven by the rotating engine, drivingly reciprocates the plungers of the pump assembles 2–7 within the respective plunger barrels to pressurize fuel for pressure delivery of fuel to the cylinders of the engine successively in a predetermined order and in quantities corresponding to the position of a control rod 10 which is interlocked with an accelerator pedal, not shown, to control the effective strokes of the plungers.

As previously noted, in this type fuel injection pump, conventionally the supply of fuel to each of the pump assemblies 2–7 through the fuel intake connector 8 is effected, for instance, by means of communication bores formed in the pump housing to communicate the fuel intake connector 8 with the respective pump assemblies 2–7, which makes the machining operation of the pump housing 1 rather complicate and hard. Therefore, a measure for feeding of fuel to the pump assemblies is desired, which facilitates such machining operation.

Figure 2:
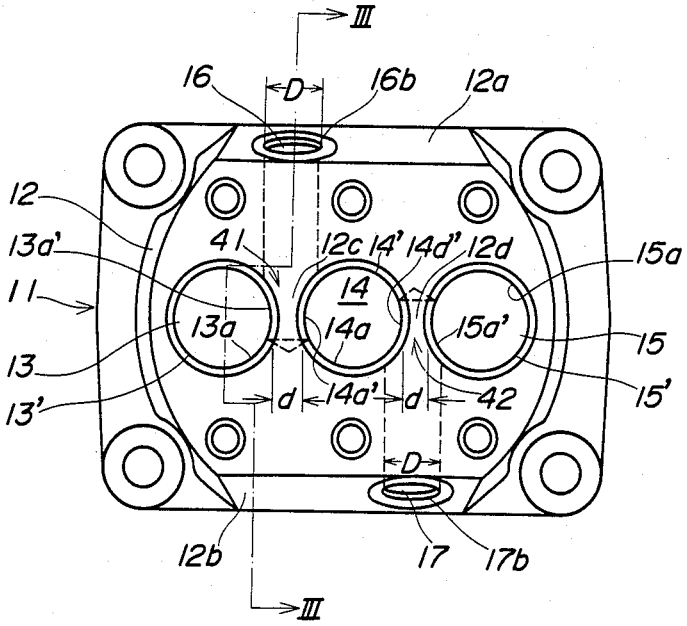
FIG. 2 is a schematic top plan view illustrating the pump housing of an in-line type fuel injection pump according to an embodiment of the invention.
Figure 3:
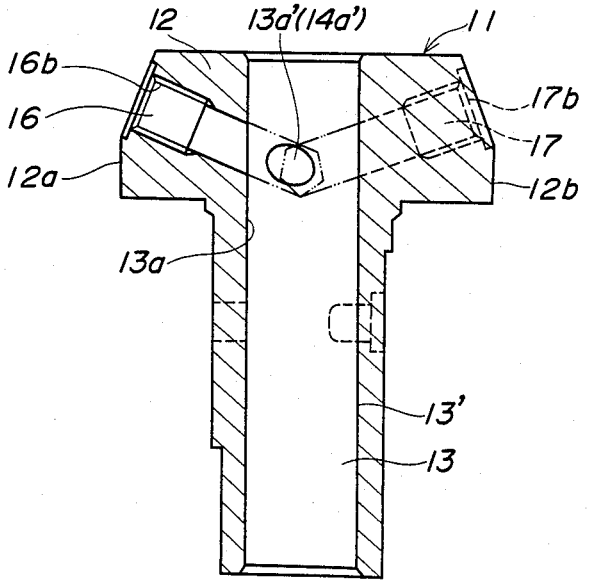
FIG. 3 is a vertical sectional view taken along line III—III in FIG. 2.

FIGS. 2 and 3 illustrate an in-line type fuel injection pump adapted for use with Diesel engines according to an embodiment of the invention. In the figures, reference numeral 11 designates a pump housing which is formed with a plurality of, for instance three, pump accommodating spaces 13–15 corresponding in number to the cylinders of the engine, arranged in a line at predetermined intervals. More specifically, the pump accommodating spaces 13'–15' are formed, respectively, by cylindrical holes 13–15 each having a circular cross section and vertically formed through the pump housing, and in which are mounted pump elements including plunger barrels and plungers, as hereinafter described.

The pump housing 11 has its upper portion formed integrally with a flange 12 which is formed therein with two bores 16 and 17. The bore 16 extends from a sloped end face 12*a* of the flange 12 forming part of the outer wall surface of the pump housing, to a partition wall portion 12*c* formed within in the pump housing 11, intervening between two adjacent pump accommodating spaces 13, 14 and separating them from each other, while the bore 17 extends from an opposite sloped end face 12*b* forming another part of the outer wall surface of the pump housing, to a partition wall portion 12*d* in the pump housing, intervening between two adjacent pump accommodating spaces 14, 15 and separating them from each other. Thus, the two bores 16, 17 extend downwardly obliquely at predetermined angles with respect to the upper surface of the pump housing 11. The bores or interior diameters D of the bores 16, 17 are set at a value larger than the width d of the partition wall portions 12*c*, 12*d*, that is, the distance between the inner peripheral surfaces of the adjacent pump accommodating spaces 13, 14 or 14, 15. The inner end of the bore 16 terminates in both of the inner peripheral wall surfaces 13*a*, 14*a* of the pump accommodating spaces 13, 14 at predetermined regions 13*a'*, 14*a'*. On the other hand, the inner end of the bore 17 terminates in both of the inner peripheral wall surfaces 14*a*, 15*a* of the pump accommodating spaces 14, 15 at predetermined regions 14*a''*, 15*a''*. Consequently, the pump accommodating spaces 13, 14 communicate with each other by way of a fuel passage 41 formed by the opening 13*a'*, the bore 16 and the opening 14*a'*, whereas the pump accommodating spaces 14, 15 communicate with each other by way of a fuel passage 42 formed by the opening 14*a''*, the bore 17 and the opening 15*a'*.

On the other hand, the other openings 16*b*, 17*b* of the bores 16, 17 formed at the end faces 12*a*, 12*b* of the flange 12 can serve as a fuel inlet port and a fuel outlet port, respectively, both connected to a fuel tank, not shown, by way of a fuel supply conduit and a fuel return conduit, not shown.

In the above manner, the adjacent pump accommodating spaces 13–15 are communicated with each other through the respective fuel passages 41, 42 for feeding and discharging fuel to and from them.

Figure 4:
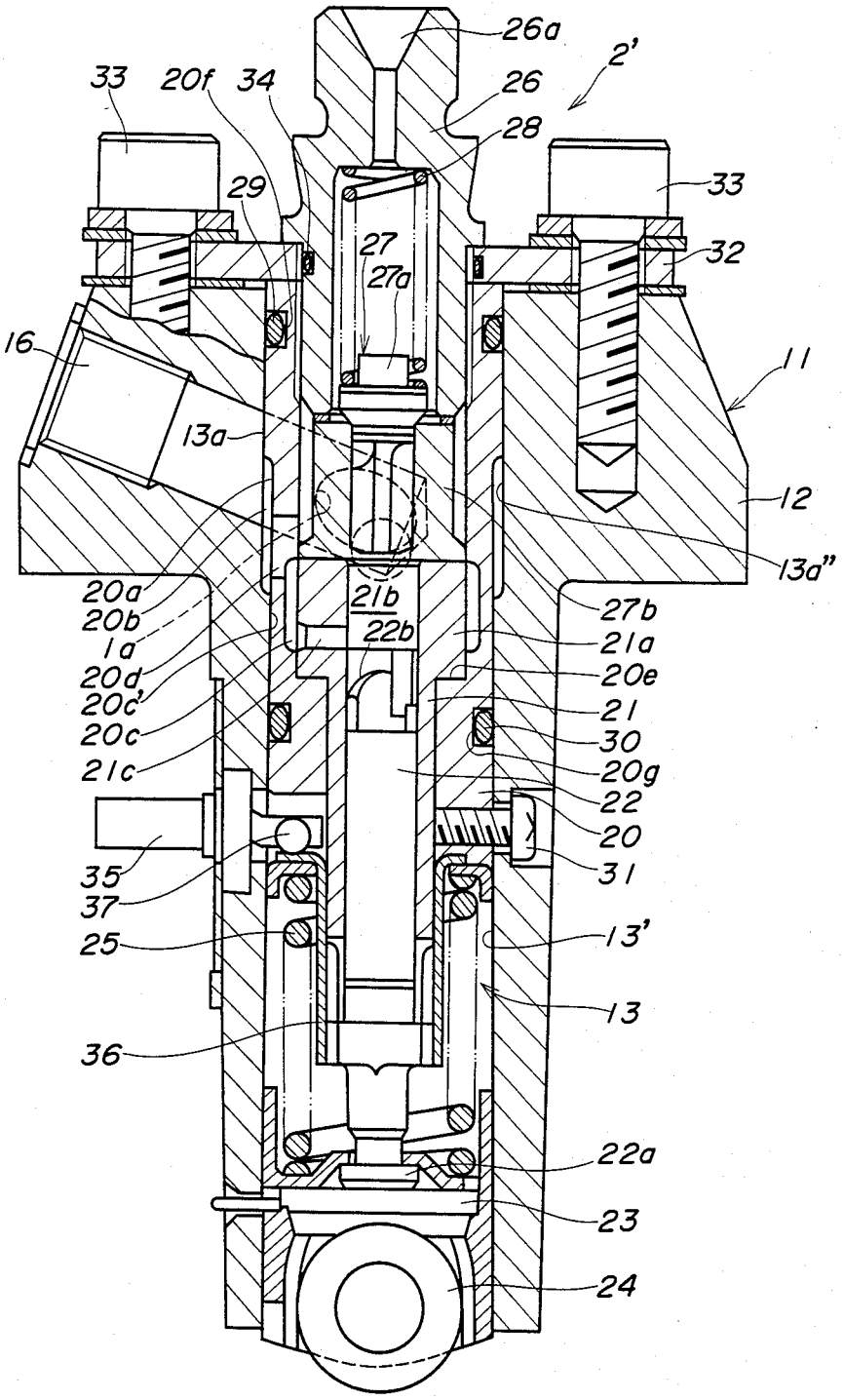
FIG. 4 is a vertical sectional view illustrating, by way of example, an in-line type fuel injection pump in which the pump housing of FIGS. 2 and 3 is incorporated.

Referring next to FIG. 4, there is illustrated an example of an in-line type fuel injection pump to which is applied the pump housing of FIGS. 2 and 3 according to the invention. Mounted within the pump accommodating spaces of the pump housing 11 are a plurality of sets of pump elements forming pump assemblies. More specifically, taking the pump accommodating space 13 for instance, a sleeve 20 is fitted in the pump accommodating space 13 and held in a predetermined circumferential position relative to the pump housing 11 by a set screw 31. Fitted in the sleeve 20 is a plunger barrel 21 which is prohibited from circumferential dislocation relative to the pump housing 11, by the above set screw 31, with its upper flange 21*a* fitted in an annular stepped shoulder 20*e* formed in the inner peripheral wall of the sleeve 20 to hold the plunger barrel 21 in a predetermined axial position. Slidably fitted within the plunger barrel 21 is a plunger 22 for reciprocating motion therein and engaging with a control sleeve 36 which in turn engages with a control rod 35 via a ball 37 to b5 controlled in circumferential position in response to displacement of the control rod 35. The plunger 22 has its lower end 22*a* kept in urging contact with a tappet 23 by the force of a plunger spring 25 for returning the plunger 22, and the tappet 23 is disposed in engagement with a camming surface of a camshaft, not shown, connected to the crankshaft of the engine, not shown.

A delivery valve holder 26 is threadedly fitted in the sleeve 20 and held in liquidtight engagement therewith by an O-ring 34 fitted therearound, and the sleeve 20 is fixed to the pump housing 11 by means of an element holder 32 secured to the pump housing 11 by fastening bolts 33. The above delivery valve holder 26 holds a valve seat 27*b* of a delivery valve 27 in contact with the plunger barrel 21, and accommodates a valve spring 28 urging a valve body 27*a* of the delivery valve 27 against a valve seat 27*b* of same in which the valve body 27*a* is slidably fitted. O-rings 29 and 30 are fitted in the outer periphery of the sleeve 20, respectively, at upper and lower locations to seal the sleeve 20 against the cylindrical hole 13' in a liquidtight manner. An annular stepped recess 20*a* is formed in the outer peripheral surface of the sleeve 20 over the whole circumference at a location opposite the opening 13*a'* in the inner peripheral surface 13*a* of the pump accommodating space 13 to define an annular communication passage 20*b* in cooperation with an annular stepped recess 13*a''* formed in the above inner peripheral surface 13*a*. Defined between an annular groove 20*c''* formed in the inner peripheral surface of the sleeve 20 and the outer peripheral surface of the flange 21*a* of the plunger barrel 21 is an annular chamber 20*c* as a fuel chamber which is in communication with the above annular communication passage 20*b* through a plurality of through holes 20*d* formed through the peripheral wall of the sleeve 20, only one of which is shown. A feed hole 21*c* is formed through the flange 21*a* of the plunger barrel 21 at a predetermined axial position, which communicates the fuel chamber 20*c* with an internal space 21*b* as a delivery chamber, defined between the plunger barrel 21 and the plunger 22. Thus, a first pump assembly 2' is mounted in the pump accommodating space 13, which is arranged as above. As noted above, the annular communication passage 20*b* of the first pump assembly 2' communicates on one hand with the delivery chamber 21*b* in the plunger barrel 21 through the holes 20*d*, the fuel chamber 20*c* and the feed hole 21*c*, and on the other hand with the bore 16 through the opening 13*a'*.

Though not illustrated, the other pump accommodating spaces 14, 15 accommodate second and third pump assemblies having identical constructions with that of the first pump assembly described above. As will be learned from FIG. 2, a second annular communication passage, not shown, formed in the second pump assembly, which corresponds to the annular communication passage 20*b* appearing in FIG. 4, is in communication with the bores 16, 17 via the openings 14*a'*, 14*a''*, and that formed in the third pump assembly with the bore 17 via the opening 15*a'*, respectively. Thus, the first to third pump assemblies continuously communicate with each other via the fuel passages 41, 42.

The operation of the in-line type fuel injection pump is as follows: In the first pump assembly, fuel from the fuel tank is supplied to the fuel chamber 20*c* via the opening (fuel inlet) 16*b* of the bore 16, the fuel passage 41, the annular communication passage 20*b* and the holes 20*d*, and then the fuel in the fuel chamber 20*c* is fed into the delivery chamber 21*b* in the plunger barrel 21 through the feed hole 21*c*. To the second and third pump assemblies, fuel is supplied, respectively, through the fuel passage 41 and the fuel passage 42 communicating with the second annular communication passage, in the same manner as in the first pump assembly 2'.

On the other hand, the camshaft, not shown, rotating in unison with the rotating engine, the roller 24 and the tappet 23 are reciprocatingly moved to cause a reciprocating motion of the plunger 22 within the plunger barrel 21. Pressurization of fuel takes place in the delivery chamber 21*b* from the time the upper end face of the plunger 22 blocks the feed hole 21*c* to the time the upper edge of a control groove 22*b* formed in the plunger 22 reaches the feed hole 21*c*, and the pressurized fuel forces the valve body 27*a* of the delivery valve 27 to lift against the force of the valve spring 28 so that the pressurized fuel is fed through a hole 26*a* formed in the delivery valve holder 26, an injection pipe and an injection nozzle, which are not shown, to be injected into an associated cylinder of the engine. After each delivery of fuel, the plunger spring 25 forces the plunger 22 downward in unison with the rotating camshaft, into the initial position shown in FIG. 4. The other pump assemblies operate in a manner identical with the first pump assembly 2'. An amount of fuel in excess of required one in the pump assemblies is guided to the opening (fuel outlet) 17*b* of the bore 17 through the fuel passages 41, 42, and returned to the fuel tank.

Although in the illustrated embodiment the fuel chamber 20*c* is provided between the inner peripheral surface of the sleeve 20 and the outer peripheral surface of the plunger barrel 21 fitted in the sleeve 20, such fuel chamber may alternatively be formed in the outer peripheral surface of the sleeve 20.

The arrangement according to the invention described above greatly facilitates machining of the pump housing, enhancing the productivity or yield, resulting in a reduced manufacturing cost. Further, it permits arranging the pump assemblies with smaller distances between them, enabling the whole size of the pump compact.

While a preferred embodiment of the invention has been described, obviously modifications and variations are possible in the light of the above teachings. It is therefore to be understood that within the scope of the appended claims, the invention may be practiced otherwise than as specifically described.

What is claimed is:

1. An in-line type fuel injection pump comprising:

a pump housing having a plurality of pump accommodating spaces formed therein and arranged in a line, said pump accommodating spaces each having an inner peripheral surface, and a plurality of partition wall portions formed in said pump housing and separating adjacent ones of said pump accommodating spaces from each other, said pump housing having an outer wall surface;

a plurality of pump assemblies accommodated, respectively, in said pump accommodating spaces, said pump assemblies each including a plunger barrel mounted within a corresponding one of said pump accommodating spaces, and a plunger disposed for reciprocating motion within said plunger barrel for pressure delivery of fuel; and a plurality of fuel passaages formed in said pump housing, said fuel passages extending from said outer wall surfaces of said pump housing to respective ones of said partition wall portions, each of said fuel passages having an interior diameter larger than the width of a corresponding one of said partition wall portions, said fuel passages each having an inner end terminating in both of said inner peripheral wall surfaces of said two adjacent ones of said pump accommodating spaces at predetermined regions to thus communicate them with each other, and said fuel passages having an outer end terminating in said outer wall surface of said pump housing;

said outer wall surface of said pump housing including two opposite side surfaces of said pump housing; and said fuel passages including at least one first fuel passage extending in said pump housing from one of said opposite side surfaces of said pump housing to a corresponding one of said partition wall portions, and at least one second fuel passage extending in said pump housing from the other of said opposite side surfaces of said pump housing to another corresponding one of said partition wall portions.

2. An in-line type fuel injection pump as claimed in claim 1, wherein at least one of said first and second fuel passages is disposed to supply fuel to said pump assemblies, and the other of said first and second fuel passages is disposed to discharge fuel from said pump assemblies.

3. An in-line type fuel injection pump as claimed in claim 1, including a sleeve fitted within said each pump accommodating space and in which said plunger barrel mounted in said each pump accommodating space is fitted, an annular communication passage formed between each of said pump accommodating spaces and said sleeve, a fuel chamber formed between said sleeve and said plunger barrel mounted therein, and means communicating said annular communication passage with said fuel chamber, said inner end of one of said fuel passages opening in said each pump accommodating space opening in said annular communication passage.

4. An in-line type fuel injection pump as claimed in claim 3, wherein said means communicating said annular communication passage with said fuel chamber comprises at least one through hole formed through said sleeve.

5. An in-line type fuel injection pump as claimed in claim 1, wherein said at least one first fuel passage and said at least one second fuel passage are arranged alternately with each other.

6. An in-line type fuel injection pump comprising:

a pump housing having a plurality of pump accommodating spaces formed therein and arranged in a line, said pump accommodating spaces each having an inner peripheral surface, and a plurality of partition wall portions formed in said pump housing and separating adjacent ones of said pump accommodating spaces from each other, said pump housing having an outer wall surface;

a plurality of pump assemblies accommodated, respectively, in said pump accommodating spaces, said pump assemblies each including a plunger barrel mounted within a corresponding one of said pump accommodating spaces, and a plunger disposed for reciprocating motion within said plunger barrel for pressure delivery of fuel;

a plurality of fuel passaages formed in said pump housing, said fuel passages extending from said outer wall surface of said pump housing to respective ones of said partition wall portions, each of said fuel passages having an interior diameter larger than the width of a corresponding one of said partition wall portions, said fuel passages each having an inner end terminating in both of said inner peripheral wall surfaces of said two adjacent ones of said pump accommodating spaces at predetermined regions to thus communicate them with each other, and said fuel passages having an outer end terminating in said outer wall surface of said pump housing;

said outer wall surface of said pump housing including two opposite side surfaces of said pump housing; and said fuel passages including a first fuel passage extending in said pump housing from one of said opposite side surfaces of said pump housing to one of said partition wall portions, and a second fuel passage extending in said pump housing from the other of said opposite side surfaces of said pump housing to another one of said partition wall portions.

7. An in-line type fuel injection pump as claimed in claim 6, wherein one of said first and second fuel passages is disposed to supply fuel to said pump assemblies, and the other of said first and second fuel passages is disposed to discharge fuel from said pump assemblies.

8. An in-line type fuel injection pump as claimed in claim 6, including a sleeve fitted within said each pump accommodating space and in which said plunger barrel mounted in said each pump accommodating space is fitted, an annular communication passage formed between each of said pump accommodating spaces and said sleeve, a fuel chamber formed between said sleeve and said plunger barrel mounted therein, and means communicating said annular communication passage with said fuel chamber, said inner end of one of said fuel passages opening in said each pump accommodating space opening in said annular communication passage.

9. An in-line type fuel injection pump as claimed in claim 8, wherein said means communicating said annular communication passage with said fuel chamber comprises at least one through hole formed through said sleeve.

* * * * *